United States Patent [19]

Ogawa

[11] Patent Number: 4,733,440

[45] Date of Patent: Mar. 29, 1988

[54] BELT BUCKLE

[75] Inventor: Koichi Ogawa, Yokohama, Japan

[73] Assignee: Nifco Inc., Yokohama, Japan

[21] Appl. No.: 59,913

[22] Filed: Jun. 9, 1987

[30] Foreign Application Priority Data

Jul. 18, 1986 [JP] Japan ..... 61-110058[U]

[51] Int. Cl.[4] ..... A44B 11/25; A44C 5/18

[52] U.S. Cl. ..... 24/170; 24/585

[58] Field of Search ..... 24/585, 580, 581, 170, 24/194, 191, 328

[56] References Cited

U.S. PATENT DOCUMENTS

| | | | |
|---|---|---|---|
| 621,109 | 3/1899 | Lester | 24/585 |
| 2,904,866 | 9/1959 | Carter | 24/170 |
| 2,916,786 | 12/1959 | Legat | 24/170 |
| 3,113,362 | 12/1963 | Petruzziello | 24/585 |
| 3,852,855 | 12/1974 | Bengtsson | 24/170 |

FOREIGN PATENT DOCUMENTS

| | | | |
|---|---|---|---|
| 1111466 | 2/1956 | France | 24/585 |

*Primary Examiner*—Victor N. Sakran

*Attorney, Agent, or Firm*—Trexler, Bushnell, Giangiorgi & Blackstone, Ltd.

[57] ABSTRACT

The present invention relates to improvements on buckles used for belts, and more particularly it is used for fastening a belt which is provided with a plurality of shallow engagement grooves in a direction perpendicular to the direction of fastening of the belt. According to this buckle, an engagement piece is projected on the buckle body which is to be engaged with said grooves provided on the belt and which is capable of elastic deformation. The engagement piece can be pressed by a cam piece of a manipulating member which is pivotally fixed to the buckle body for swinging motion. The cam piece presses the engagement piece to release the same from the groove, thereby to unfasten and let the belt loosen.

1 Claim, 15 Drawing Figures

BELT BUCKLE

DETAILED DESCRIPTION OF THE INVENTION

(Background of the Invention)

In the prior art, there were rougly two types of buckles that are used for fastening a belt by providing plural grooves on the belt itself and elastically engaging a hook provided on the buckle with the grooves.

One type of such buckles consists of, as shown in FIGS. 10 through 12, a buckle body 101 of which cross section is substantially in U-shape because of side walls erected on two opposing sides of its bottom wall, a shaft 102 which is suspended between said side walls of the buckle body 101, a manipulating member 103 which is mounted on said shaft 102, and a coil spring 104 which elastically presses one end 103*a* of the manipulating member 103 toward the bottom plate of the body 101 with the other end 103*b* acting as a tongue for pressing operation. The buckle of this construction is attached to bags, shoes, belts, etc. by suitable means such as screws.

A space is provided between the body 101 and the manipulating member 103 through which the belt C is inserted. The belt C is provided with plural engagement grooves c . . . c in the longitudinal direction thereof, or more particularly in the direction of fastening/unfastening of the belt, the grooves being perpendicular to the fastening/unfastening direction. Various improvements are made on the configuration of these grooves c . . . c, but serrated grooves comprising a tapered face c′ gradually cutting deeper in the direction of the free end of the belt C and a perpendicular c″ rising from the deepest portion of the tapered face.

With the buckle having the above structure, the belt C with its side having the grooves c . . . c facing the manipulating member 103 is inserted between the buckle body 101 and the manipulating member 103, whereby the belt C is inserted pushing up the manipulating member 103 in resistance against the elastic spring force of the coil spring 104. By suspending the insertion of the belt C at an arbitrary position for fastening, the end 103*a* of the manipulating member 103 engages elastically with the face c″ of the groove c in the belt C to prevent the belt from slipping out in the unfastening direction. The belt C is unfastened by pressing the end 103*b* of the manipulating member 103 toward the buckle body 101 to release the end 103*a* from the groove c of the belt C.

According to a second conventional embodiment, instead of utilizing the rotatable manipulating member, the buckle body 111 is made a flat tube to allow insertion of the belt C therethrough. FIGS. 13 and 15 show the conventional buckle according to this embodiment. An elastic hook 111*a* is projected inwardly from the bottom wall of the body 111 within the tube in a gentle inclination from one inlet port 111*b*′ for belt insertion toward the other port 111*b*″. Further, a claw 111*a*′ is provided on the free end of the hook 111*a* to face the port 111*b*″ and a stepped portion 111*a*″ is provided between the claw 111*a*′ and the free end of the hook. A lock releasing means 112 each is integrally formed on the side of the stepped portion 111*a*″ of the hook 111*a* in a substantially U-shape and a catch 112*a* each at the respective free end of the releasing part 112 is exposed from a window 113 each formed on both sides of the buckle body 111.

With this structure, as the belt C is inserted from the port 111*b*′ of the buckle body 111 with its grooves c facing the hook 111*a*, the tapered face c′ of the belt C slides over the claw 111*a*′. The belt C presses down the hook 111*a* resisting against the resilience of the hook 111*a*. As one stops feeding the belt C through the buckle, the claw 111*a*′ of the hook 111*a* is caught by the face c″ of the groove c to prevent unfastening of the belt C. The belt C is unfastened by pressing the catch 112*a* of the means 112 toward the bottom wall of the buckle body 111 to release the claw 111*a*′ of the hook 111*a* from the groove c.

With the prior art embodiments as mentioned above, it was necessary to press the end 103*b* of the manipulating member 103 or the catch 112*a* of the means 112 toward the buckle body 111 to unfasten the belt C. In case the bag or the shoes to which the buckle body is attached is made of a soft material, or the buckle body is attached to the material of a bag without firm support, or the position where the buckle body is to be positioned cannot be defined as in the case of various types of belts, the manipulating member 103 or the means 112 could not be appropriately pressed and often caused inadequate release.

With the conventional structure wherein the engagement of the buckle body and the belt C is released by manipulating the member 103 or the means 112 by means of the pressing force acting from the top of the buckle body 101, 111 toward the bottom surface, the belt may be inadvertently unfastened when pushed by people in the crowd or when contacted with other object to thereby cause the member 103 or the means 112 to operate.

Moreover, whenever the pressure acting on the manipulating member 103 or the means 112 is released, such members are immediately energized and become locked in the groove c of the belt C again. This makes it necessary to keep the manipulating member 103 or the part 112 constantly pressed toward the buckle body 101 or 111 respectively until the belt C is completely unfastened or until it reaches a desired position, making the buckle manipulation complicated and often involving both hands.

(Objects and Construction of the Invention)

The present invention relates to improvements on the prior type buckles. The main object of the proposed buckle is to keep the belt and the buckle to be continuously released of their engagement while the belt is unfastened from the buckle.

Another object of the invention is to enable fastening-/unfastening of the belt with one hand releasing the belt and the buckle at will and by continuously maintaining this released state.

Still another object of the invention is to provide a buckle which removes the need to press the buckle body against the bag, shoes, etc. for unfastening the belt from the buckle, so that the belt can be easily unfastened even when the article to which the buckle is attached is made of a soft material or when the buckle must be manipulated in the air with nothing to press against.

Still another object of the present invention is to provide a buckle which can be held fastened in a stable manner by preventing the belt inserted in the belt from inadvertently slipping off by a pressing force acting on the buckle.

These and other objects of the present invention will become more apparent from the following description.

The present invention will now be described in more detail referring to the accompanying drawings.

Figure 1:
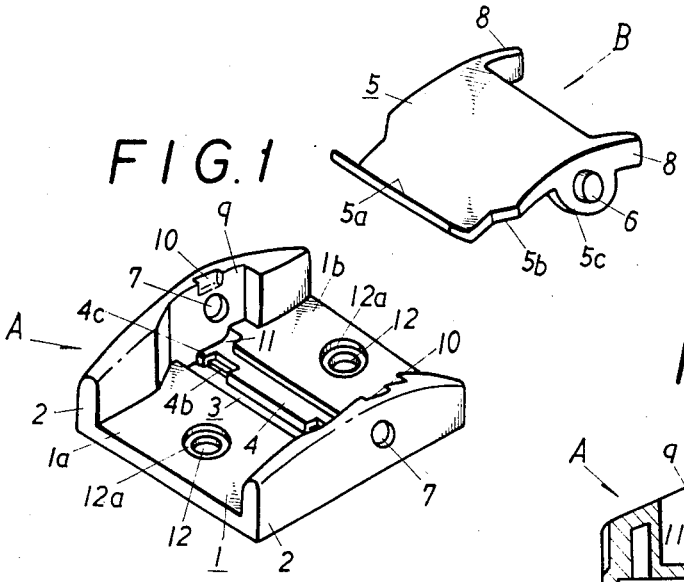
FIG. 1 shows a partially exploded perspective view of a buckle according to the present invention.
Figure 4:
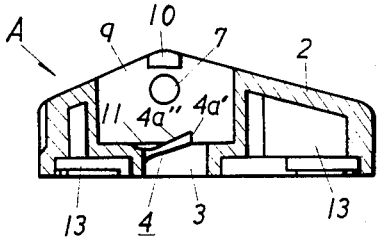
FIG. 4 is a sectional view along the line E—E in FIG. 2.
Figure 2:
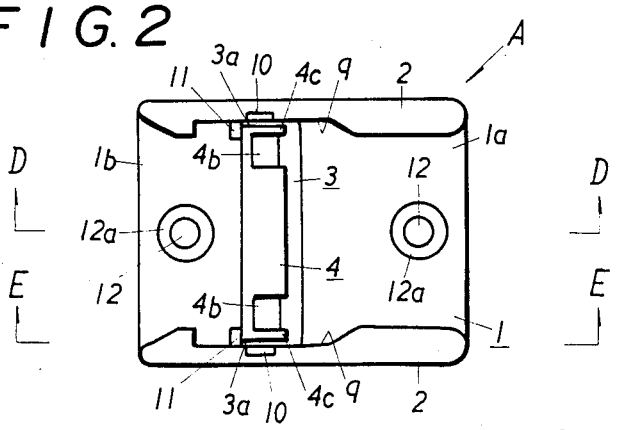
FIG. 2 shows the buckle body in plan view.
Figure 5:
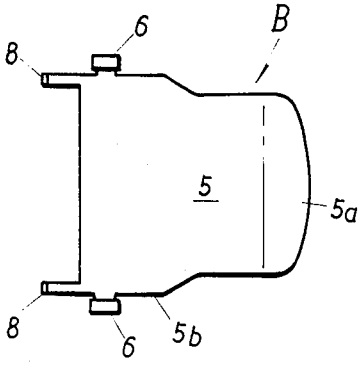
FIG. 5 shows the manipulting member in plan view.
Figure 3:
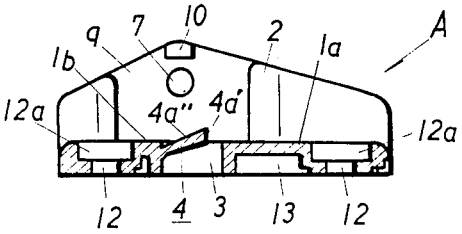
FIG. 3 is a sectional view along the line D—D in FIG. 2.
Figure 6:
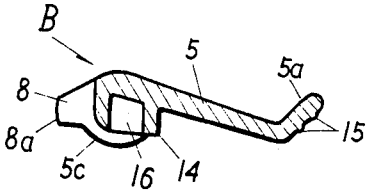

FIG. 6 its sectional view.

Figure 7:
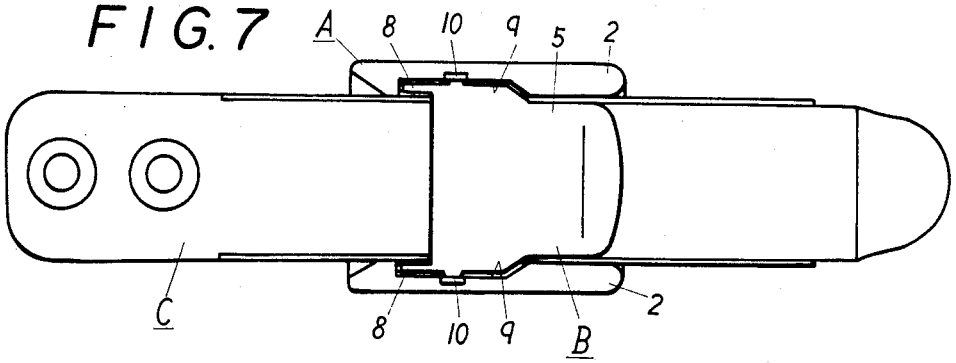

FIG. 7 shows the buckle inserted with the belt in plan view and

Figure 8:
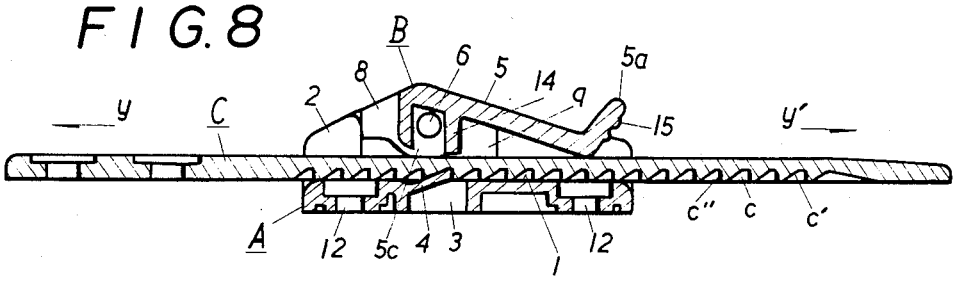

FIG. 8 a sectional view thereof.

Figure 9:
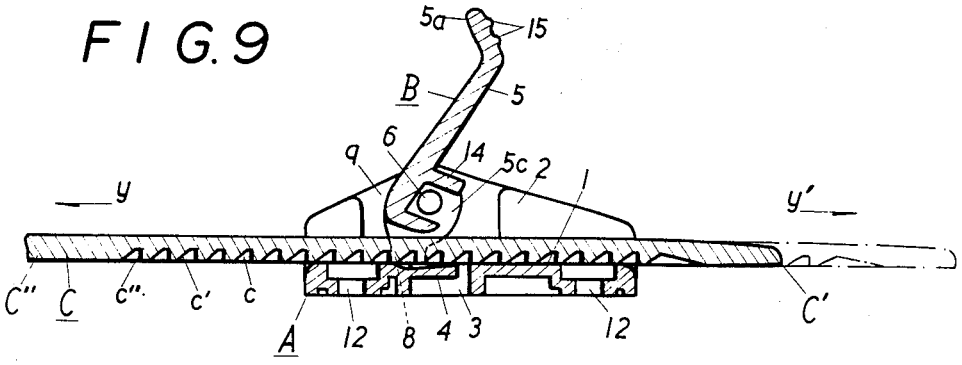

FIG. 9 is a sectional view to show releasing of the buckle.

Figure 10:
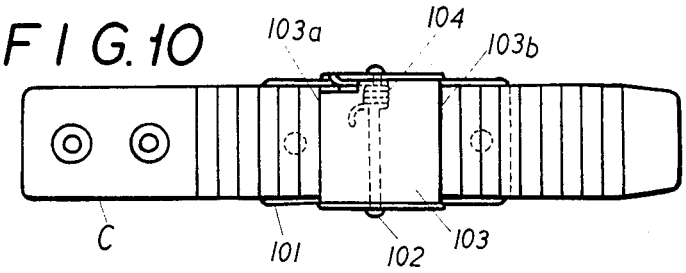
Figure 11:
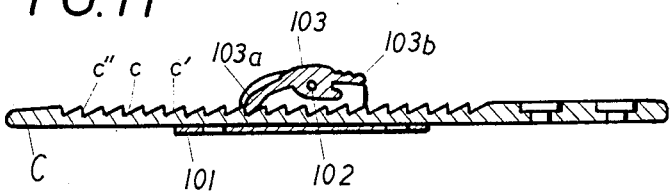

FIG. 10 is a plan view to show the prior art embodiment,

FIG. 11 its sectional view, and

Figure 12:
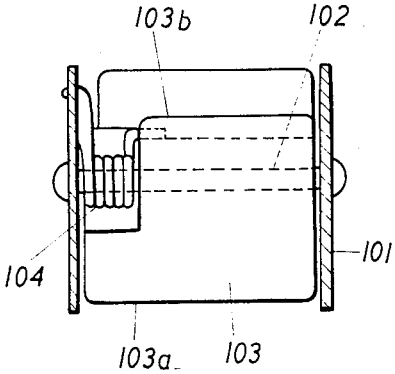

FIG. 12 a plan view of the buckle.

Figure 13:
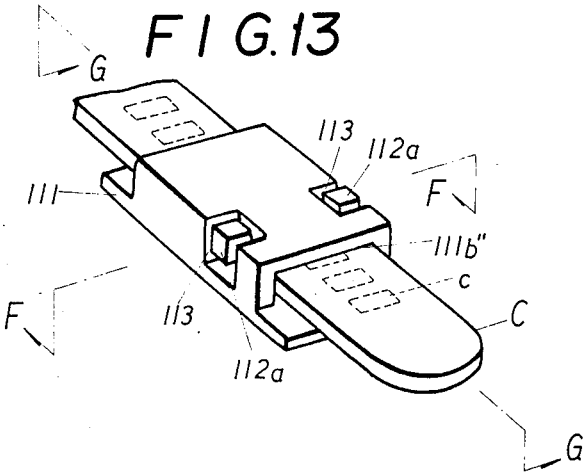
Figure 14:
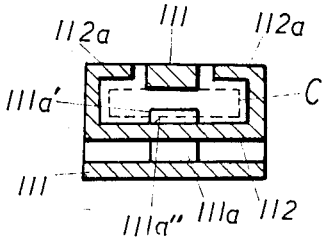

FIG. 13 is a perspective view of another embodiment according to the prior art,

FIG. 14 a sectional view along the line F—F in FIG. 13, and

Figure 15:
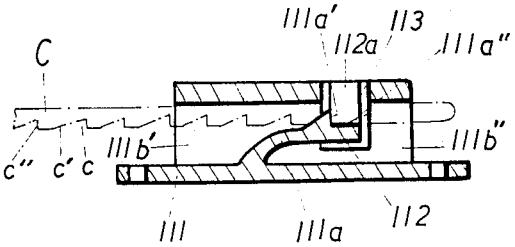

FIG. 15 another sectional view along the line G—G.

The buckle according to the present invention comprises of two principal parts, i.e. the buckle body A and the manipulating member B. The buckle body A comprises a bottom wall 1 substantially in rectangle and side walls 2, 2 erected on the two opposing sides of said bottom wall 1 to form a substantial U-shape in cross section. A slot 3 penetrates through the bottom wall 1 of the buckle body A between the side walls 2, 2, sectioning the bottom wall into two. One side of the bottom wall thus sectioned is bent obliquely upward to form an engaging piece 4 which is elastically deformable. The manipulating member B comprises a plate member 5 which is a substantial rectangle and covers the bottom wall 1 of the buckle body A, with rods 6, 6 provided on both ends thereof at one side and hinged to holes 7, 7 made on the side walls 2, 2. A cam piece 8 extends from each of the rods 6 in the direction opposite to the plate member 5. The engaging piece 4 of the buckle body A is made capable of bending toward the bottom wall 1 by means of the cam pieces 8 of the manipulating member B.

Because of the construction mentioned above, the buckle according to the present invention allows the belt C to be inserted to an arbitrary position by inserting the same through the interval between the buckle body A and the manipulating member B, or from the side on which the plate member 5 is hinged with its face having the grooves c of the belt C facing the bottom wall 1 of the buckle body A. As the engagement piece 4 is pressed down toward the bottom wall 1, the belt can remain free of engagement while being inserted. It is of course possible to insert the belt C by lifting the plate member 5 and pressing the engagement piece 4 toward the bottom wall 1 by means of the cam piece 8, but it will be easier to bring the plate member 5 down toward the buckle body A and release the engagement between the cam piece 8 and the engagement piece 4 to allow the belt C for insertion.

When the belt C is thus inserted, the upper end of the engagement piece 4 abuts against the face c″ of the groove c in the belt C and the upper surface abuts against the face c′ to become engaged, preventing the belt from slipping in the unfastening direction.

The belt C thus fastened can be undone by lifting the plate member 5 so that the engagement piece 4 is pressed down by the cam piece 8 toward the bottom wall 1 to release its engagement with the belt C. It is noted that the plate member 5 can be lifted by lifting the belt C instead of the plate member 5. In either case, the plate member is lifted and held immobile, maintaining the released state.

Because of the construction and actions mentioned above, it is not necessary with the buckle according to the present invention to hold the manipulating member B of the buckle in place when the belt C is unfastened, enabling the unfastening of the belt with one hand. As it is not necessary to hold the manipulating member B of the buckle toward the buckle body, the belt C can be readily unfastened even when the surface where the buckle is attached is made of a soft material or if the buckle is attached to a surface with no support. It is a further advantage of the present invention that as the engagement between the engagement piece 4 and the belt C can not be released even if the manipulating member B is pressed, it allows a secure and safe use even in crowded places.

(Embodiment)

A concrete embodiment of the buckle according to the present invention will now be described in detail. It is noted that the embodiment described below is merely one example of products manufactured in accordance with the present invention and is in no way the sole embodiment of the invention.

The buckle according to the present invention comprises a buckle body A and a manipulating member B. Typically, the buckle body A and manipulating member B are injection molded using synthetic resin. The buckle body A comprises a rectangular bottom wall 1 and side walls 2, 2 erected on the opposing sides of the bottom wall 1. A dented portion 9 is made inside the side wall 2 at substantially the center thereof to receive a cam piece 8 of the manipulating member B to be described later. A through-hole 7 is formed at the upper middle portion of the dented portion 9. The side wall 2 is pointed at the portion corresponding to the hole 7 and has a tapered groove 10 on the inside at its crest. The tapered groove 10 is utilized for securing the manipulating member B to the buckle body A. It is so constructed that in actual use, the rod 6 of the member B is guided into the hole 7.

The bottom wall 1 interposed between the side walls 2, 2 is sectioned into two parts by the slot 3 extending between the side walls 2, 2. The bottom wall 1 thus sectioned into two parts by a slot 3 mainly comprises a bottom portion **1*a* to be covered by a plate member 5 which will be described later and a bottom portion 1*b* on the side corresponding to the cam piece 8 which is also described later. An engagement piece 4 extends therefrom over the slot 3**.

The slot 3 is situated substantially below said hole 7 and has a sufficient width for the engagement piece 4 to be pressed into it. The engagement piece 4 is bent from the side of the bottom portion **1*b* along the slot 3 toward the bottom portion 1*a* in a gentle slope above the slot 3. The margin of the bent portion of the engagement piece 4 is such that the engagement piece 4 enters into the slot 3** completely.

In order to give sufficient elasticity to the engagement piece 4, the piece 4 is completely separated from the side wall 2 via a portion 3*a* of the slot 3. The upper surface 4*a*″ of the engagement piece 4 is a gentle slope rising in the direction of the bottom portion 1*a* and its free end is a perpendicular wall 4*a*′, whereby the engagement piece 4 is adapted for engagement with belt C to be described later.

The portion each of the engagement piece 4 near the side wall is made a thin walled portion 4*b*, 4*b* and the portion interposed between the portion 4*b* and the side periphery is termed as an abutting portion 4*c*, 4*c*, which comes in contact with the cam piece 8 to be described later. Because of the thin walled portion 4*b*, the action of the cam piece 8 against the abutting portion 4*c* is transmitted to the engagement piece 4 in a somewhat buffered manner.

The bottom portion 1*b* at the base of the abutting portion 4*c* which is within the range of cam piece 8 action is made a concave 11 to facilitate the swinging motion of the cam piece 8 and to thereby ensure pressing of the abutting portion 4*c* by the cam piece 8.

In the drawings, the reference number 12 denotes a hole which receives a screw and the like means for attaching the buckle body A to bags, etc. and has a stepped portion 12*a* with a larger diameter. The reference number 13 denotes a void intended for reducing resin consumption and the buckle weight.

The manipulating member B will now be described. The manipulating member B is provided to extend between the side walls 2, 2 of the buckle body A and is shaped like a plate covering the bottom wall 1. The manipulating member B essentially consists of a plate member 5 which covers the bottom portion 1*a*. The portion with a greater width is termed portion 5*b*. Lobe 5*c* are formed on both sides of the portion 5*b*, to which a rods 6 are respectively provided. A stopper 14 extends between the lobes 5*c*, 5*c* to energize the belt C to be inserted toward the engagement piece 4. The stopper 14 has a hollow portion 16 to reduce its thickness.

Cam pieces 8 respectively protrude from the rods 6 in the direction opposite to the plate member 5. The cam piece 8 is on the extension line of the portion 5*b*. Thus, the portion 5*b* including the cam piece 8 and the lobe 5*c* will sit in a dent 9 made in the side wall 2. It is so structured that the lobe 5*c* and the cam piece 8 do not come in contact with the belt C as it is inserted in the buckle.

The manipulating member B slopes down in both directions with the portion corresponding to the rod 6 as the crest, such that when the manipulating member B locks the belt C as is inserted in the buckle A in place, the plate member 5 will be positioned lower than the position where the manipulating member B is hinged (FIG. 8) and that the free end 8*a* of the cam piece 8 will be substantially perpendicular.

The free end of the sloping plate member 5 is again bent upward to form a tongue 5*a* which is provided with ribs 15—15 to prevent slipping and to facilitate picking up of the manipulating member B.

The belt C will now be described. The belt C to be inserted in the buckle has a row of grooves c . . . c in the direction perpendicular to the insertion of the belt C. The groove c comprises a perpendicular c″ on the side of the free end C′ of the belt C (i.e. the direction in which the belt C is inserted into the buckle, as indicated by the arrow y′) and a gentle slope c′ extending from the perpendicular c″ toward the base C″ of the belt C (i.e. the direction in which the belt C is withdrawn, as indicated by the arrow y).

With the buckle of the present invention having the construction as mentioned above, the belt C is inserted between the manipulating member B and the bottom wall 1 from the portion 1*b* of the buckle body A, whereby the slope c′ of the groove c of the belt C comes in contact with the inclined face 4*a*″ of the engagement piece 4 and slides into the buckle by causing elastic deformation of the face 4*a*″ to press the same into the slot 3 (the belt C being inserted in the direction of the arrow y′ in FIG. 8). As the movement of the belt C stops, the perpendicular face 4*a*′ becomes engaged with the perpendicular c″ of the groove c to prevent the belt C from slipping off (in the direction of the arrow y). The belt C is interposed between the engagement piece 4 and the stopper 14 to maintain the engagement between the piece 4 and the groove c. At the same time, the base of the tongue 5*a* of the plate member 5 is in contact with the upper surface of the belt C, the contact position being lower than the position where the plate member 5 is hinged (the rod 6) and closer to the bottom wall 1 so that the plate member 5 is prevented from being lifted.

The manipulation for unfastening the belt C will now be described.

In order to unfasten the belt C, the manipulating member B is swung up about the rod 6 by lifting the tongue 5*a* as shown in FIG. 9. By lifting the piece B, the stopper 14 faces sideways and the stopper 14 and the engagement piece 4 will not oppose each other. And, as the cam piece 8 presses the abutting portion 4*c* of the engagement piece 4 at its base (on the side of the dent 11) into the slot 3, the engagement piece 4 (via the thin walled portion 4*b*) is pressed into the slot 3 and disengaged from the belt C. As a result, the belt C moves freely both in the directions of the arrow y and arrow y′. By fully lifting the manipulating member B so that the free end 8*a* of the cam piece 8 which is substantially perpendicular is positioned lower than the rod 6 which is the fulcrum of the manipulating member B to come closer to the bottom portion 1*a*, the manipulating member B can be kept lifted. When the manipulating member B is forced into the tapered groove 10 by utilizing the elastic deformation of the side walls 2, 2 of the buckle body A to guide the rod into the hole 7, the portion 5*b* and the lobe 5*c* of the manipulating member B will press strongly against the surface of the dent 9 in the side wall 2. As a result, the manipulating member B is supported by the resilience of the side walls 2, 2 to maintain its closed position. In this manner, the belt C can be securely fastened and unfastened.

The buckle according to the present invention with its construction as mentioned above enables a belt to be fastened/unfastened by merely pressing the belt C into the buckle, and it offers an advantage of securely maintaining the inserted belt in its place.

The inserted belt C is firmly engaged by the engagement piece 4 and thus will not slip off. When the belt C is to be unfastened, the engagement piece 4 is forced into the slot 3 by lifting the manipulating member B by the plate member 5 to allow the belt to freely move in either direction of the arrow y or y′. Moreover, once the manipulating member B is lifted, it can be held in this position enabling the belt to be unfastened with one hand.

What I claim is:

1. A buckle comprising a channel-shaped buckle body having a bottom wall and a pair of substantially parallel side walls respectively upstanding from the opposite longitudinal edges of said bottom wall, said bottom wall having a resilient latching member extending obliquely therefrom for resilient latching engagement with a groove in the underside of a belt or the like, and a manually operable release member pivotally connected to said side walls above said latching member, said release member having a cam portion engageable with said latching member from above the further having a finger piece, said finger piece being manually engageable to pivot said release member and thereby to remove said cam portion from a rest position spaced above said latching member into engagement with said latching member and thereby to deflect said latching member resiliently down and away from latching engagement with a groove in the underside of a belt or the like.

* * * * *